United States Patent [19]

Barrington

[11] 4,060,140

[45] Nov. 29, 1977

[54] METHOD AND APPARATUS FOR PREVENTING DEBRIS BUILD-UP IN UNDERWATER OIL WELLS

[75] Inventor: Burchus Q. Barrington, Duncan, Okla.

[73] Assignee: Halliburton Company, Duncan, Okla.

[21] Appl. No.: 731,251

[22] Filed: Oct. 12, 1976

Related U.S. Application Data

[63] Continuation-in-part of Ser. No. 624,950, Oct. 22, 1975, abandoned.

[51] Int. Cl.[2] ..... E21B 15/02

[52] U.S. Cl. ..... 175/7; 166/.5; 175/312

[58] Field of Search ..... 175/5, 6, 7, 215, 308, 175/309–312, 65; 166/.5, .6, 99, 162, 163, 242, 243

[56] References Cited

U.S. PATENT DOCUMENTS

| | | | |
|---|---|---|---|
| 2,670,930 | 3/1954 | Farrar | 175/308 |
| 3,012,610 | 12/1961 | Bauer et al. | 175/7 X |
| 3,102,600 | 9/1963 | Jackson | 175/308 |
| 3,137,348 | 6/1964 | Ahlstone et al. | 166/.6 |
| 3,142,344 | 7/1964 | Otteman et al. | 166/.5 X |
| 3,163,220 | 12/1964 | Haeber et al. | 166/.6 |
| 3,247,914 | 4/1966 | Slack | 175/7 |
| 3,459,270 | 8/1969 | Schuh | 175/7 |
| 3,465,817 | 9/1969 | Vincent | 175/7 X |
| 3,486,555 | 12/1969 | Vincent | 166/.5 |

*Primary Examiner*—Ernest R. Purser

*Assistant Examiner*—Richard E. Favreau

*Attorney, Agent, or Firm*—John H. Tregoning; James R. Duzan

[57] ABSTRACT

An improved method and apparatus for preventing buildup of cuttings or debris in underwater oil wells. The apparatus includes a drilling tool in the form of a primary tubular member having an internal diameter a predetermined amount greater than the external diameter of a drill string which is run downwardly through a conventional riser pipe string and underwater wellhead assembly. The drilling tool preferably includes an external shoulder formed on the lower end portion thereof for engagement with a corresponding internal shoulder at the juncture of the riser pipe string and the wellhead assembly for supporting the tool independently of the drill string. An annular resilient seal can be included on the lower end portion of the tool for providing a fluid-tight seal between the lower end portion of the tool and the juncture of the riser pipe string and the wellhead assembly. The tool can include a second tubular member connected at its lower end to the lower end of the primary tubular member. An annular space, open at its upper end, can thus be provided between the two tubular members of the tool for trapping cuttings and debris which may settle out from circulating or non-circulating mud in the annulus between the drill string and the riser pipe string above the tool. The tool is adapted to be retrieved with the drill string upwardly through the riser pipe string to the water surface where any cuttings and debris trapped therein can be disposed of without falling back to the bottom of the borehole.

29 Claims, 11 Drawing Figures

METHOD AND APPARATUS FOR PREVENTING DEBRIS BUILD-UP IN UNDERWATER OIL WELLS

This is a continuation-In-Part of U.S. Pat. application Ser. No. 624,950 filed Oct. 22, 1975, now abandoned.

This invention relates generally to improvements in oil and gas well drilling and more particularly, but not by way of limitations, to improvements in mud systems and methods of their employment in oil and gas well drilling operations.

A conventional technique employed in the drilling of underwater oil and gas wells involves the utilization of a riser pipe string to communicate between an underwater wellhead assembly, secured to the underwater floor, and the water surface at a drilling barge or platform. Ordinarily, the lengths of typical riser pipe strings range between 200 and 800 feet and the inside diameter of the riser pipe strings is generally in excess of sixteen inches. During drilling, cuttings from the bottom of the well are carried therefrom in a drilling mud solution which is pumped downwardly through the tubular drill string and circulated upwardly in the annulus between the drill string and the borehole, wellhead assembly and riser pipe string to the water surface. These cuttings and other debris from the bottom of the well can be delivered to the water surface provided the proper fluid velocity, mud weight and annulus areas are compatible.

It has been determined by Applicant, however, that when the annulus area between the outer diameter of the drill string and the inner diameter of the riser pipe string is very large in comparison to the annulus between the exterior of the drill string and the wall of the borehole and inner surfaces of the wellhead assembly, the drilling mud can lose the desired velocity or flow rate in the annulus between the drill string and the riser pipe string necessary to convey the cuttings and debris upwardly through the riser pipe string to the water surface for removal from the drilling mud. The cuttings and debris carried by the mud in this area of reduced velocity are held in suspension in this area as long as mud circulation continues, as shown below in FIG. 6, FIG. 7, FIG. 7A and FIG. 7B. When the mud pump stops and circulation is discontinued, the cuttings and debris can settle back to the bottom of the well. Further, when the drill string is removed and mud naturally falls within the wellbore to assume the space formerly occupied by the drill string, cuttings are pushed downwardly out of the riser pipe string into the wellbore. Although this problem in underwater well drilling appears to be universal. The predominant means currently used to combat this problem is the "piggyback system" as shown in FIG. 2 of U.S. Pat. No. 3,465,817 where an extra circulation system is employed to boost mud velocity in the riser annulus. However, such a system is cumbersome, requires extra motors or pumps, is inefficient and, as known to those currently drilling offshore wells, is not generally very effective. Junk baskets such as shown in U.S. Pat. No. 3,102,600 are known for land wells, but the applicability of such devices to the riser annulus debris problem has not therefore been appreciated. Most often no countermeasures are taken and cuttings and debris fall from the riser and remain in the bottom of the well. Such materials may thereafter adversely affect testing and cementing programs subsequently performed in the well. Circulation employed during testing can be expected to cause cuttings or debris to foul various downhole tools causing testing misruns, and to severely damage tool parts, thereby materially increasing the costs incurred in well completions in offshore areas where new production is so urgently needed. As seen in U.S. Pat. No. 3,012,610, it has been known to support a wellhead assembly on a drill bit while lowering the assembly to a drop-off point, but such technology has not been applied to solving the problem of debris accumulation in riser pipes.

The present invention contemplates a drilling tool for use with a drill string comprising a length of drill string, having at least one attachment means thereon for attaching the drilling tool, insertable within a riser pipe string in underwater drilling operations. The tool includes a first tubular member having an upper end portion, a lower end portion, an inner portion of a diameter greater than the outer diameter of a portion of the drill pipe and means, on said tool, for engaging said attachment means of said drill string to support said tool independently of said riser pipe string. The tool also includes means, on the lower end portion of the first tubular member, operatively engageable with the lower end portion of the riser pipe string for supporting the first tubular member within the lower end portion of the riser pipe string independently of the drill string. The inner diameter of said tool is sufficiently close in magnitude to the outer diameter of said drill string to create an annulus therebetween of a cross-sectional area sufficiently small to provide, at normal circulation rates, a flow velocity therethrough of a magnitude greater than the settling rate of said debris in said annulus. The tool can further include seal means for providing fluid-tight sealing engagement between the lower end portions of the first tubular member and the riser pipe string.

The present invention further contemplates a method of trapping cutting debris in an underwater drilling operation wherein a tubular drill string having a drill bit on the lower end thereof extends downwardly from the water surface within a riser pipe which extends between the water surface and an underwater wellhead assembly on the underwater floor. The method includes the steps of: inserting a device into the riser string; positioning said device adjacent the lower portion of said riser string; passing the tubular pipe string downwardly through the riser pipe string and wellhead assembly into the borehole, so as to create an annulus between said tubular pipe string and said riser pipe, wellhead assembly and borehole; circulating a liquid downwardly through the pipe string and out the lower end thereof into said annulus; circulating said liquid upwardly through the portion of said annulus between the tubular pipe string and the borehole and through the portion of said annulus between the tubular pipe string and the wellhead assembly at a flow rate sufficient to cause said liquid to have an upward flow velocity faster than the settling rate of said debris in said liquid; and circulating said liquid upwardly from the interior of said wellhead and through said annulus between the riser pipe string and the tubular pipe string while simultaneously using said device to restrict at least part of said riser portion of said annulus to a cross-sectional area sufficiently small to cause said liquid to flow therethrough with an upward velocity in excess of said settling rate.

Objects and advantages of the present invention will be evident from the following detailed description when read in conjunction with the accompanying drawings, which include:

FIG. 1, a partially schematic elevation view of the upper segment of an underwater drilling installation constructed in accordance with the present invention;

FIG. 2, an elevation view of the intermediate segment of the underwater drilling installation of FIG. 1 with portions broken away to illustrate the junk catcher drilling tool positioned in the riser pipe string;

FIG. 3, an elevation view of the lower segment of the underwater drilling installation of FIG. 1 and FIG. 2;

FIG. 4, a cross-sectional view taken along line 4—4 of FIG. 2;

FIG. 5, a fragmentary, elevation view of a portion of the intermediate segment of the underwater drilling installation with portions broken away to illustrate both the installation and retrieval of the junk catcher drilling tool of the present invention in the riser pipe string;

FIG. 6, an elevational intermediate cross-sectional view of a typical prior art underwater riser pipe string showing initial circulation of debris;

FIG. 7, the view of FIG. 6, showing further debris buildup therein;

FIG. 7A, the view of FIG. 6 showing an alternate type of debris buildup;

FIG. 7B, a transverse cross-section along lines 7B—7B of FIG. 7A, showing debris buildup in the riser string;

FIG. 8, an elevational intermediate cross-sectional view of a riser string with an alternate embodiment of the invention positioned therein; and FIG. 9, an elevational intermediate cross-sectional view of a riser string with another alternate embodiment of the invention positioned therein.

DESCRIPTION OF THE PREFERRED EMBODIMENT

Figure 1:
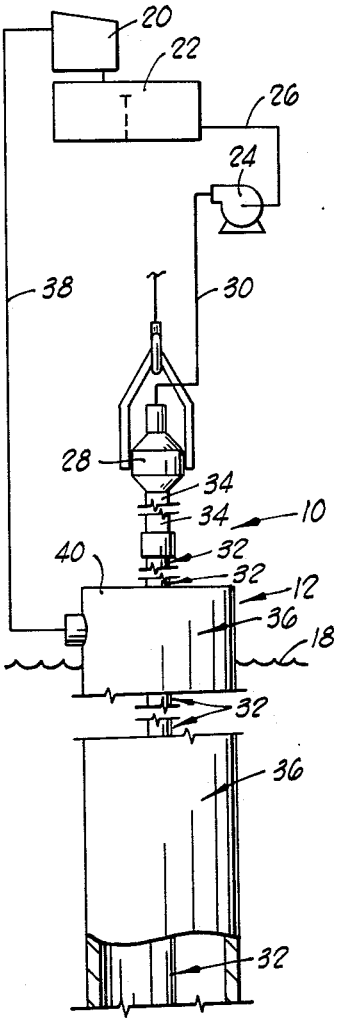

Referring now to the drawings, a preferred underwater drilling installation constructed in accordance with the present invention is illustrated therein and is generally designated by the reference character 10. To facilitate illustration, the drilling installation 10 has been broken into three segments with the upper segment 12 thereof shown in FIG. 1, the intermediate segment 14 thereof shown in FIG. 2, and the lower segment 16 thereof shown in FIG. 3.

As shown in FIG. 1, the upper segment 12 of the drilling installation 10 extends above the water surface 18 and terminates in the usual manner in an offshore drilling platform, barge or the like, which is not shown in the drawing. The upper portion of the drilling installation 10 includes a drilling mud circulation assembly comprising a shale shaker 20, mud tank or pit 22 communicating with the shale shaker 20 and a mud pump 24 having its inlet connected to the mud tank 22 via a conduit 26. The outlet of the mud pump 24 is connected to a conventional swivel 28 via a connecting conduit and stand pipe 30 in the usual manner. The outlet of the swivel 28 communicates with a conventional tubular drill string 32 via a kelly 34. The drill string 32 extends downwardly through a riser pipe string 36, the upper end of which extends above the water surface 18. A conduit or mud return line 38 communicates between the upper end 40 of the riser pipe string 36 and the inlet of the shale shaker 20.

Figure 2:
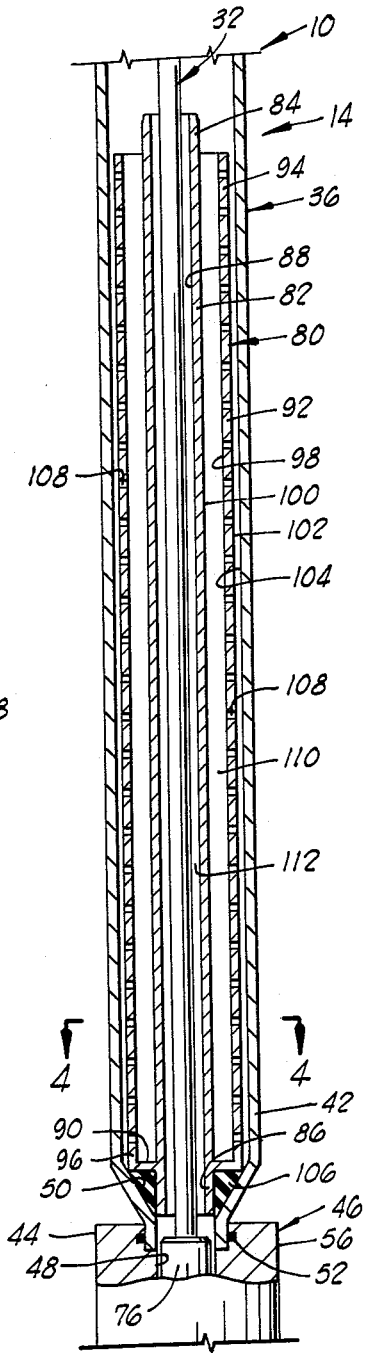

Referring now to FIG. 2, the lower end 42 of the riser pipe string 36 is disposed beneath the water surface 18 and is sealingly engaged with the upper end 44 of an underwater wellhead assembly 46. The interior of the riser pipe string 36 communicates with a vertical passage 48 in the wellhead assembly 46. An upwardly facing annular shoulder 50 can be formed in the lower end 42 of the riser pipe string 36 adjacent the juncture between the wellhead assembly 46 and the riser pipe string 36. It should be understood that the upwardly facing shoulder 50 can, alternatively, be formed in the upper end 44 of the wellhead assembly 46 adjacent the juncture between the wellhead assembly and the riser pipe string. A suitable fluid-tight seal can be achieved between the lower end 42 of the riser pipe string 36 and the vertical passage 48 of the wellhead assembly 46 by means of a suitable annular seal 52.

The wellhead assembly 46 is suitably secured to the underwater floor and can be of conventional construction. The wellhead assembly 46 comprises a suitable connector 56 at the upper end 54 thereof for connection with the lower end 42 of the riser pipe string 36. A blowout preventer 58 communicates with and is positioned below the connector 56. A gate 60, including pipe rams and shut-off rams, is positioned below the blowout preventer 58. The gate 60 communicates with a base column 62 positioned therebelow which extends downwardly therefrom through a base 64 supported on the underwater floor 54. The base column 62 preferably extends downwardly from the underwater floor 54 into a borehole 66 and is cemented therein as shown at 68.

The drill string 32 extends downwardly from the base column 62 and terminates in a suitable bit 70 for drilling additional borehole 72 beneath the lower end 74 of the base column 62.

The drill string 32 is of conventional construction and comprises a plurality of joints of drill pipe intermediate the kelly 34 and can include an upper drill collar 76, and additional drill collars 78 intermediate the upper drill collar 76 and the drill bit 70. It will be understood that the drill string 32 extends downwardly through the vertical passage 48 of the wellhead assembly 46.

Figure 8:
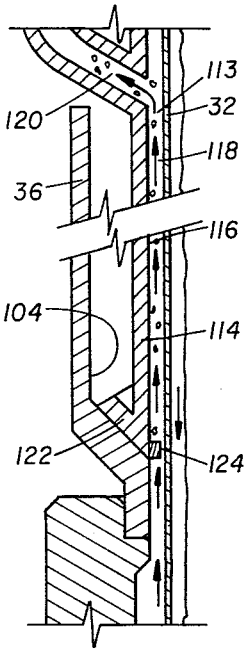

The underwater drilling installation 10 further includes a drilling tool, which can be a junk catcher 80, as shown in FIG. 2. The junk catcher 80 comprises a first tubular member 82 having an upper end portion 84, a lower end portion 86 and a cylindrical inner surface 88 having a minimum inner diameter greater than the outer diameter of the drill pipe of the drill string 32 but less than the outer diameter of the uppermost drill collar 76. This minimum inner diameter could be made less than the diameter of surface 88 by use of one or more internal ledges (see FIG. 8). An annular wall 90 extends radially outwardly from the lower end portion 86 of the first tubular member 82 and provides means on the lower end portion of the first tubular member for supporting the first tubular member on the upwardly facing shoulder 50 independently of the drill string 32. A second tubular member 92 is disposed concentrically around the first tubular member 82 and has an upper end portion 94, a lower end portion 96 secured to the annular wall 90, a cylindrical inner surface 98 having a diameter greater than the diameter of the cylindrical outer surface 100 of the first tubular member 82 and a cylindrical outer surface 102 having a diameter slightly less than the diameter of the inner cylindrical surface 104 of the riser pipe string 36.

The junk catcher 80 further includes an annular resilient seal member 106, which may be suitably formed of an elastomeric or synthetic resinous material, secured about the lower end portion 86 of the first tubular member 82 providing seal means for achieving a fluid-tight seal between the lower end portion of the first tubular member and the juncture of the lower end portion of the riser pipe string 36 and the wellhead assembly 46. It will be seen in FIG. 2 that the seal member 106 is preferably secured between the cylindrical outer surface 100 of the lower end portion 86 of the first tubular member 82 and the downwardly facing annular surface or shoulder of the annular wall 90 by suitable means such as bonding.

The junk catcher 80 further preferably includes a plurality of perforations 108 extending between the inner and outer cylindrical surfaces 98 and 102 of the second tubular member 92. The perforations 108 are sized to permit the drainage of drilling mud from the annular space 110 formed in the junk catcher 80 intermediate the cylindrical inner surface 98 of the second tubular member 92 and the cylindrical outer surface 100 of the first tubular member 82 while retaining cuttings and other debris from the borehole in the annular space 110 when the junk catcher 80 is removed upwardly through the riser pipe string 36. It will be noted in FIG. 2 that the upper end portion 84 of the first tubular member 82 extends a distance above the upper end portion 94 of the second tubular member 92.

The outer diameter of the cylindrical outer surface 102 of the second tubular member 92 is preferably selected to provide sufficient clearance between the junk catcher 80 and the cylindrical inner surface 104 of the riser pipe string 36 to permit free passage of the junk catcher 80 downwardly and upwardly through the interior of the riser pipe string 36 while minimizing the possibility of cuttings and other debris settling in the annulus between the junk catcher 80 and the inner surface 104. The inner diameter of the cylindrical inner surface 88 of the first tubular member 82 of the junk catcher 80 is selected to provide sufficient clearance between the first tubular member 82 and the cylindrical outer surface of the drill pipe of the drill string 32 to provide a cross-sectional area in the annular space 112 between the first tubular member 82 and the drill string 32 to maintain the required mud velocity to allow heavy cuttings and debris to be circulated by the mud upwardly through the annular space 112 past the upper end portion 84 of the junk catcher 80. The overall length of the junk catcher 80 is preferably approximately twenty-eight feet.

Alternatively, a compensator 114 could be used in place of junk catcher 80. Compensator 114 is a tubular conduit with an inner surface 116 of a primary inner diameter greater than the outer diameter of drill string 32. The primary inner diameter of compensator 114 is selected to provide an annulus 113 between surface 116 and the drill string 32 of sufficiently small cross section to maintain an upward mud flow velocity greater than the falling rate in drilling mud 118 of debris being circulated by said drilling mud 118. Compensator 114 extends upwardly through riser pipe string 36. Above riser pipe string 36, annulus 112 is communicted with mud return line 38 via mud outlet 120 so as to substantially avoid mud passage between compensator 114 and surface 104 of riser 36. The top of the riser 36 could be sealed relative to the compensator 114 by means of a conventional system such as seen in at reference numbers 96, 97, 107 and 108 of FIG. 9 of U.S. Pat. No. 3,137,348. Compensator 114 preferably includes a landing flange 122 to provide additional seating surface on shoulder 50 of riser pipe string 36 for added strength and better sealing. Compensator 114 could also be hung from a casing hanger at the top of the riser pipe, provided the lower end of compensator 114 is sufficiently close to the bottom of the riser pipe to prevent substantial debris accumulation. A rubber seal (not shown) or other sealing means could be added to flange 122 to provide better sealing, and to cushion contacts between shoulder 50 and compensator 114. Internal lugs 124 can be provided on inner surface 116 for positioning and retrieving compensator 114.

A further alternate to junk catcher 80 is provided by latching junk catcher 126, which is provided with collet fingers 128 or other suitable latching means such as a retractable slip or a ratchet mechanism to hold latching junk catcher 126 in position at the bottom of riser pipe string 36. Drill string 32 can include external lugs 130 cooperable with internal lugs 132 of junk catcher 126 for raising and lowering junk catcher 126 above the lower end of riser pipe string 36, or any large diameter portion thereof, such as the drill bit, or a drill collar could be utilized in place of lugs 130.

OPERATION

Looking to FIGS. 6, 7, 7A and 7B, the prior art system has been realized by Applicant to contain an inherent problem. The increased annulus between the drill string 32 and the riser pipe string results in slower upward flow therethrough. In the case of aluminum cuttings 134, the falling rate of cuttings has been found to be greater in drilling mud than the reduced upward flow velocity through the riser pipe resulting in settling as in FIGS. 7, 7A and 7B into a mass of debris at the lower end of the riser pipe string. Applicant has therefore determined that to solve this problem, either the flow area must be more restricted through the riser pipe string 36 or the debris must be trapped and removed to prevent its falling back into the borehole. Otherwise an extra circulation system must be provided to boost riser annulus flow velocity.

Figure 3:
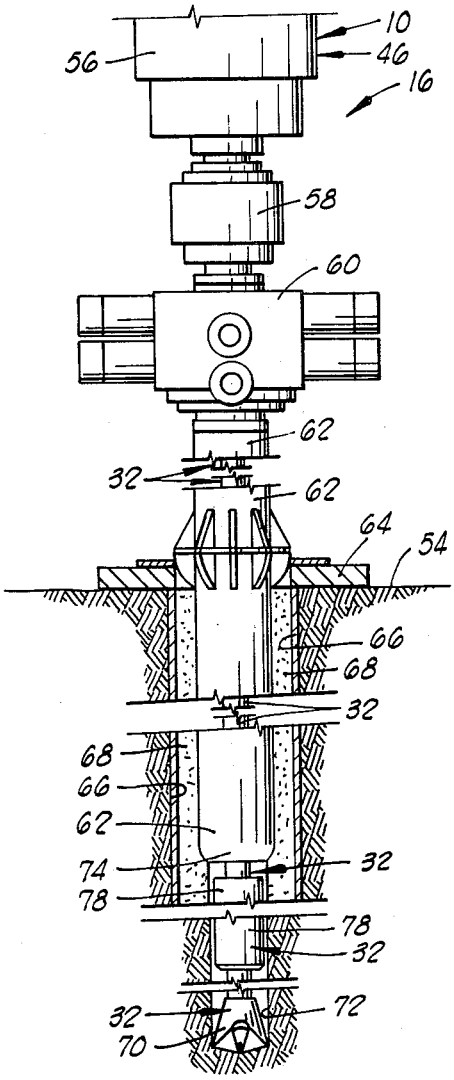
Figure 4:
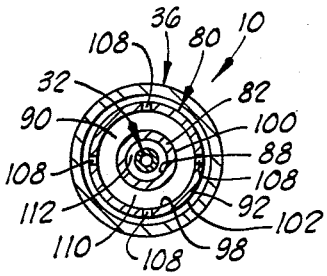
Figure 5:
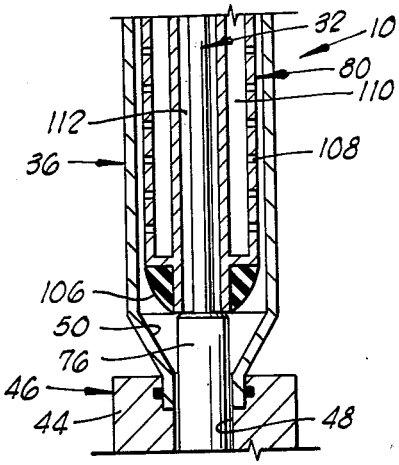
Figure 6:
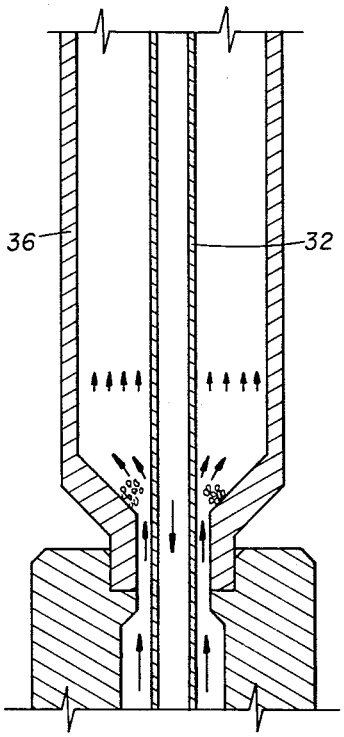
PRIOR ART FIG. 6
Figure 7:
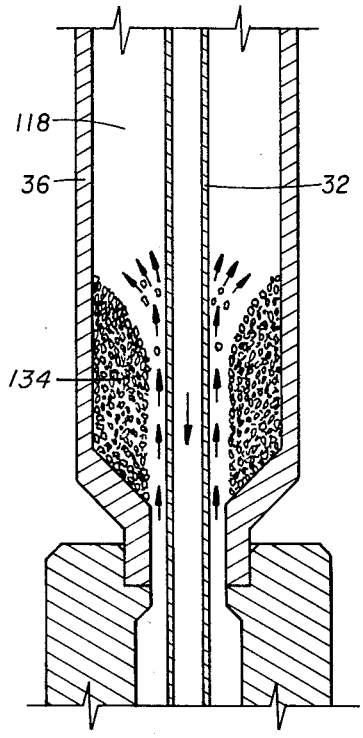
PRIOR ART FIG. 7
Figure 7A:
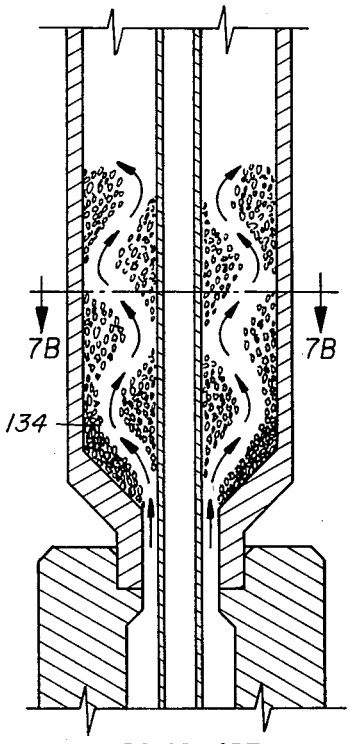
PRIOR ART FIG. 7A
Figure 9:
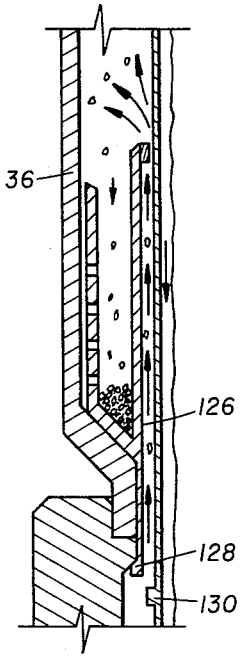
Figure 7B:
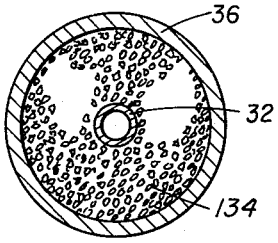
PRIOR ART FIG. 7B

Once the wellhead assembly 46 and the riser pipe string 36 are placed in proper position, as illustrated in FIGS. 1, 2 and 3, in the well-known conventional manner, the drill string 32 may be run in the riser pipe string 36 and wellhead assembly 46 to form or extend the borehole 72. The drill string 32 is assembled with the drill bit 70 on the lower end portion thereof and with drill collars 76 and 78 spaced thereabove. The junk catcher 80 is then positioned about the first length of drill pipe secured above the drill collar 76. The junk catcher 80 is supported on the drill string 32 by the uppermost drill collar 76 or other means such as lugs 130 or drill bit 70 as illustrated in FIGS. 5 and 9. The drill string 32 is lowered downwardly through the riser pipe string 36 and the wellhead assembly 46 through the addition of additional lengths of drill pipe thereto in a conventional manner. When the junk catcher 80 reaches the lower end portion of the riser pipe string 36, the resilient annular seal member 106 sealingly engages the upwardly facing annular shoulder 50 thus terminating the downwardly movement of the junk catcher 80 within the riser pipe string 36 and supporting the junk catcher 80 therein independently of the drill string 32. The junk catcher 80 preferrably can be latched or otherwise held in position as in FIG. 9. The drill string 32 is lowered further within the riser pipe string 36 and the wellhead assembly 46 until the drill bit 70 contacts the bottom of the borehole 72. The weight of the junk catcher 80 bearing on the annular shoulder 50 through the annular resilient seal member 106 preferably provides a fluid-tight seal between the lower end portion 86 of the first tubular member 82 of the junk catcher 80 and shoulder 50.

When drilling commences, drilling mud 118 is circulated from the mud tank or pit 22 through conduit 26 to the mud pump 24 and through the conduit and stand pipe 30 to the swivel 28. Mud further passes downwardly from the swivel through the kelly 34 and drill string 32 and out the lower end portion thereof through the drill bit 70 to flush cuttings and debris from the bottom of the borehole 72 and circulate the cutting debris upwardly with the drilling mud through the annulus between the exterior of the drill string and the borehole 72 or casing upwardly to the wellhead assembly 46. The cutting and debris laden drilling mud circulates further upwardly through the annulus between the exterior of the drill string 32 and the vertical passage 48 through the wellhead assembly 46 into the lower end portion of the riser pipe string 36. The mud and debris further circulates upwardly through the annular space 112 between the junk catcher 80 or compensator 114 or latching junk catcher 126 and the exterior of the drilling string 32 when junk catcher 80 is used the mud continues upwardly beyond the upper end portion 84 of the first tubular member 82 of the junk catcher 80 into the annular space between the exterior of the drill string 32 and the cylindrical inner surface 104 of the riser pipe string 36.

Since the inner diameter of the cylindrical inner surface 88 of the first tubular member 82 is selected to provide the annular space 112 with a cross-sectional area sufficiently small to maintain the cuttings and debris in suspension in the circulating drilling mud, substantially all of the cutting debris will be circulated upwardly from the bottom of the borehole past the upper end portion of the junk catcher 80 into the annulus between the drill pipe and the riser pipe string.

Since the length of the riser pipe string 36 can ordinarily be expected to range between 200 and 800+ feet between the wellhead assembly 46 and the water surface 18, and since the inner diameter of the riser pipe string 36 is usually in excess of sixteen inches, cuttings and debris from the bottom of the borehole which have been carried upwardly in suspension in the drilling mud either remain in suspension in the drilling mud or begin to fall slowly downwardly since the cross-sectional area of the annulus between the drill string and the riser pipe string is very large in comparison to the annulus between the drill string and the borehole, casing, wellhead assembly and junk catcher 80, thus causing the circulating drilling mud to lose sufficient upward velocity to continue circulating the cuttings and debris upwardly through the riser pipe string to the upper end 40 thereof where the cuttings and debris may be removed from the drilling mud for passage through the shale shaker 20 and mud pit 22 in the usual manner.

It will be seen that the cuttings and debris which settle from the drilling mud in the annulus between the drill string 32 and the riser pipe string above the junk catcher 80 will be collected within the annular space 110 in the junk catcher 80. Further, when the circulation of drilling mud is terminated, for purposes of replacing the drill bit or the like, cuttings and debris which were previously suspended in the drilling mud above the junk catcher 80 also settle into the annular space 110 of the junk catcher 80, thus preventing the cuttings and debris from falling back through the wellhead assembly 46 to the bottom of the borehole in sufficient quantities to cause difficulties in testing and cementing operations. When the drill string 32 is withdrawn from the borehole upwardly through the wellhead assembly 46 and the riser pipe string 36, the uppermost drill collar 76, or drill bit 70, or lugs 130 or other suitable engagement means engages the lower end portion of the junk catcher 80, or suitable engagement means thereon as shown in FIG. 5, whereby the junk catcher 80 is withdrawn upwardly through the riser pipe string 36 to the rig floor with the drill string 32. The perforations 108 in the second tubular member 92 of the junk catcher 80 permit the drainage of drilling mud from the annular space 110, thus minimizing the difficulty in disassembling the drill string 32 and junk catcher 80 at the rig floor. After the junk catcher 80 is emptied at the water surface, it can then be reinstalled on the drill string 32 and reinserted therewith into the riser pipe string 36 for continued drilling operations.

It will be understood that the junk catcher 80 may also be run with pipe strings which are to be employed for testing purposes, drilling purposes, or both. The use of the junk catcher 80 will be found to be advantageous at any time forward circulation of mud is to be employed with a pipe string in a riser pipe string and it is forseen that debris will be circulated out of the borehole by the mud, or might otherwise be present in the riser pipe which debris might be anticipated to cause various problems in drilling, testing or cementing operations if such debris were permitted to be returned to or remain in the borehole.

It will also be apparent that the invention is equally applicable to oil well operations below lakes or rivers as well as offshore.

From the foregoing it will be seen that the present invention provides method and apparatus providing distinct advantages over known mud systems which facilitate drilling, cementing and testing underwater oil and gas wells. Changes may be made in the combination and arrangement of parts or elements as heretofore set forth in the specification and shown in the drawings without departing from the spirit and scope of the invention as defined in the following claims.

What is claimed is:

1. A drilling tool, for use with a drill string insertable within a riser pipe string in underwater drilling operations, comprising:

a first tubular member having an upper end portion, a lower end portion and an inner diameter greater than the outer diameter of at least a part of the drill string by less than a predetermined amount;

support means adjacent said lower end portion of said first tubular member for supporting said first tubular member at a first position within at least the lower end portion of said riser pipe string independently of said drill string; and carrier means for carrying said tubular member on said drill string independently of said riser pipe string at positions above said first position.

2. The apparatus as defined in claim 1, further comprising:

trap means disposed about and supported by said first tubular member for trapping cuttings and debris which fall from suspension in the drilling mud above the upper end portion of said first tubular member.

3. The drilling tool as defined in claim 1, wherein said support means comprises:

a downwardly facing shoulder extending radially outwardly from said first tubular member and having a maximum diameter slightly less than the primary internal diameter of said riser pipe yet larger than the internal diameter of the bottom of said riser string.

4. The apparatus of claim 1, wherein:

said drill string includes a drill bit and said inner diameter of said first tubular member is less than the outer diameter of said drill bit, whereby said tool may be raised and lowered by said drill bit.

5. The apparatus of claim 1, wherein:

said drill string includes a drill bit; and said first tubular member includes one or more internal radial projection means thereon for engaging said drill bit so as to support said first tubular member when said drill bit is positioned above said lower end portion of said riser pipe string.

6. The apparatus of claim 1, wherein:

said drill string includes a drill collar; and said inner diameter of said first tubular member is less than the outer diameter of said drill collar, whereby said tool may be raised and lowered by said drill collar.

7. The apparatus of claim 1, wherein:

said drill string includes a drill collar; and said first tubular member includes one or more internal radial projection means thereon for engaging said drill collar so as to support said first tubular member when said drill collar is positioned above said lower end portion of said riser pipe string.

8. The apparatus of claim 1, wherein:

said first tubular member extends upwardly through the top of said riser pipe string when at said first position, whereby upward fluid flow is restricted through said riser pipe.

9. The apparatus of claim 1, further comprising:

hold-down means for maintaining said first tubular member in said first position.

10. The apparatus of claim 1, further comprising:

seal means for providing fluid-tight sealing between the lower end portions of said first tubular member and said riser pipe string.

11. The drilling tool as defined in claim 10 wherein said seal means comprises:

a resilient annular seal disposed about the lower end portion of said first tubular member.

12. The drilling tool as defined in claim 10, wherein said seal means comprises:

an annular resilient seal member disposed about and secured to the lower end portion of said first tubular member adjacent said annular wall.

13. The apparatus as defined in claim 12, wherein said seal means for providing fluid-tight sealing engagement between the lower end portions of said first tubular member and said riser pipe string is characterized further to include:

an annular elastomeric seal member disposed about the lower end portion of said first tubular member and fixedly secured to the lower end portion of said first tubular member and said annular wall.

14. The apparatus as defined in claim 1, further comprising:

trap means disposed about said first tubular member for trapping cuttings and debris which fall from suspension in the drilling mud above the upper end portion of said first tubular member.

15. The drilling tool as defined in claim 14, wherein said trap means comprises:

a second tubular member disposed about said first tubular member and having an upper end portion, a lower end portion, an inner diameter greater than the outer diameter of said first tubular member and an outer diameter less than the primary inner diameter of said riser pipe string; and an annular wall interconnecting the lower end portions of said first and second tubular members.

16. The drilling tool as defined in claim 15, wherein said second tubular member is characterized further as being perforated.

17. The drilling tool as defined in claim 15, wherein said carrier means comprises:

a downwardly facing annular shoulder adjacent the juncture of said annular wall and the lower end portion of said second tubular member and having a maximum external diameter slightly less than the primary internal diameter of said riser pipe yet larger than the internal diameter of the bottom of said riser string.

18. The drilling tool as defined in claim 15, wherein the upper end portion of said first tubular member extends a distance above the upper end portion of said second tubular member.

19. A method, of preventing settling of debris into a borehole in an underwater drilling operation wherein a riser pipe string, adapted to receive a tubular pipe string therewithin, extends between the water surface and an underwater wellhead assembly on an underwater floor, which comprises the steps of:

a. inserting a device into the riser pipe string;

b. positioning said device adjacent the lower portion of said riser pipe string thereby creating an annulus between said device and said riser pipe string throughout at least a substantial portion of the length of said lower portion of said riser pipe string;

c. passing the tubular pipe string downwardly through the riser pipe string and wellhead assembly into the borehole, so as to create an annulus between said riser pipe string, wellhead assembly and borehole;

d. circulating a liquid downwardly through the tubular pipe string and out the lower end thereof into said annulus;

e. circulating said liquid upwardly through the portion of said annulus between the tubular pipe string and the borehole and through the portion of said annulus between the tubular pipe string and the wellhead assembly at a flow rate sufficient to cause said liquid to have an upward flow velocity faster than the settling rate of said debris in said liquid; and f. circulating said liquid upwardly from the interior of said wellhead assembly and through said annulus between the riser pipe string and the tubular pipe string while simultaneously using said device to restrict said annulus throughout at least a substantial portion of the length of said lower portion of said riser pipe string to a cross-section area sufficiently small to cause said liquid to flow therethrough with an upward velocity in excess of said settling rate of said debris.

20. The method of claim 19, which further comprises the step of:

retrieving said device from said annulus, while maintaining said riser pipe in a fixed position.

21. The method of claim 19, which further comprises the step, simultaneous with step (f), of:

preventing said liquid from circulating within said annulus between said device and said riser pipe string.

22. A method of trapping debris from a borehole in an underwater drilling operation wherein a tubular pipe string extends downwardly from the water surface within a riser pipe string extending between the water surface and an underwater wellhead assembly on the underwater floor, comprising the steps of:

a. passing the tubular pipe string downwardly through the wellhead assembly into the borehole;
b. circulating a liquid downwardly through the pipe string and out the lower end thereof;
c. circulating said liquid upwardly through the annulus between the pipe string and the borehole into the annulus between the pipe string and the wellhead assembly at an upward flow velocity sufficient to carry debris from the borehole therewith;
d. circulating said liquid upwardly from the interior of said wellhead assembly into the lower portion of said riser pipe at an upward flow velocity sufficient to continue carrying the debris therewith;
e. settling the debris entrained in the liquid in the riser pipe above the lower portion thereof into the lower portion thereof;
f. trapping the settled debris in the lower portion of the riser pipe; and
g. removing the trapped debris upwardly from the riser pipe.

23. A method of trapping cutting debris in an underwater drilling operation wherein a tubular drill string having a drill bit on the lower end thereof extends downwardly from the water surface within a riser pipe which extends between the water surface and an underwater wellhead assembly on the underwater floor, comprising the steps of:

a. passing the drill string downwardly through the wellhead assembly to contact the underwater floor;
b. actuating the drill string to form a borehole extending downwardly from the underwater floor;
c. circulating liquid downwardly through the drill string and out the lower end thereof;
d. circulating said liquid upwardly through the annulus between the drill string and the borehole into the interior of the wellhead assembly at a flow rate sufficient to carry cuttings and debris therewith;
e. circulating said liquid upwardly from the interior of said wellhead assembly into the lower portion of the annulus between the drill string and the riser pipe at a flow rate sufficient to continue carrying cuttings and debris therewith;
f. reducing the flow rate of the liquid at a point above the lower portion of the annulus between the drill string and the riser pipe sufficiently to prevent the continued upward movement of at least a portion of the cutting debris with the liquid;
g. terminating the circulating of said liquid in the drill string, in the annulus between the drill string and the borehole in the interior of the wellhead assembly, and in the annulus between the drill string and the riser pipe;
h. allowing the cuttings and debris entrained in the liquid in the annulus between the drill string and the riser pipe to settle to the lower portion of said annulus;
i. trapping the cuttings and debris in the lower portion of the annulus between the drill string and the riser pipe; and
j. removing the trapped cuttings and debris from the riser pipe to the water surface.

24. A drilling tool, for use with a drill string insertable within a riser pipe string having an internal shoulder in the lower portion thereof in underwater drilling operations, comprising:

a first tubular member having an upper end portion, a lower end portion and an inner diameter greater than the outer diameter of at least a part of the drill string by less than a predetermined amount;
support means for supporting said first tubular member at a first position within at least the lower end portion of said riser pipe string independently of said drill string;
carrier means for carrying said tubular member on said drill string independently of said riser pipe string at positions above said first position; and
flange means for seating said first tubular member on said internal shoulder in the lower portion of said riser pipe string when said first tubular member is supported in said first position within at least the lower end portion of said riser pipe string.

25. The apparatus of claim 24, wherein:

said first tubular member extends upwardly through the top of said riser pipe string when at said first position, whereby upward fluid flow is restricted through said riser pipe.

26. A drilling tool, for use in underwater drilling operations with a drill string insertable within a riser pipe string which mates with a wellhead assembly having an upwardly facing internal shoulder, said tool comprising:

a first tubular member having an upper end portion, a lower end portion and an inner diameter greater than the outer diameter of at least a part of the drill string by less than a predetermined amount;
support means for supporting said first tubular member at a first position within at least the lower end portion of said riser pipe string independently of said drill string;
carrier means for carrying said tubular member on said drill string independently of said riser pipe string at positions above said first position; and
flange means for seating said first tubular member on said upwardly facing internal shoulder of said wellhead assembly when said first tubular member is supported in said first position within at least the lower end portion of said riser pipe string.

27. The apparatus of claim 26, wherein:

said first tubular member extends upwardly through the top of said riser pipe string when at said first position, whereby upward fluid flow is restricted through said riser pipe.

28. A method, of preventing settling of debris into a borehole in an underwater drilling operation wherein a riser pipe string, adapted to receive a tubular pipe string therein, extends between the water surface and an underwater wellhead assembly on an underwater floor, which comprises the steps of:

a. inserting a device into the riser pipe string;
b. positioning said device adjacent the lower portion of said riser pipe string;
c. extending said device upwardly through said riser pipe string to adjacent the top of said riser pipe string;

d. passing the tubular pipe string downwardly through the riser pipe string and wellhead assembly into the borehole, so as to create an annulus between said tubular pipe string and said riser pipe, wellhead assembly and borehole;

e. circulating a liquid downwardly through the tubular pipe string and out the lower end thereof into said annulus;

f. circulating said liquid upwardly through the portion of said annulus between the tubular pipe string and the borehole and through the portion of said annulus between the tubular pipe string and the wellhead assembly at a flow rate sufficient to cause said liquid to have an upward flow velocity faster than the settling rate of said debris in said liquid; and g. circulating said liquid upwardly from the interior of said wellhead assembly and through said annulus between the riser pipe string and the tubular pipe string while simultaneously using said device to restrict said annulus throughout the length of said riser pipe string to a cross-sectional area sufficiently small to cause said liquid to flow therethrough with an upward velocity in excess of said settling rate of said debris.

29. The method of claim 28, which further comprises the step, simultaneous with step (f), of:

preventing said liquid from circulating within an annulus between said device and said riser pipe string.

* * * * *